United States Patent [19]

Battocchi

[11] Patent Number: 4,799,335

[45] Date of Patent: Jan. 24, 1989

[54] KNIFE SHARPENING DEVICE

[76] Inventor: Silvio R. Battocchi, 26 Pelham Rd., West Hartford, Conn. 06107

[21] Appl. No.: 51,711

[22] Filed: May 20, 1987

[51] Int. Cl.[4] ..... B24B 9/04; B24D 15/08

[52] U.S. Cl. ..... 51/102; 51/214; 51/285; 76/84; 76/88

[58] Field of Search ..... 51/214, 205 WG, 208, 51/74 R, 102 BS, 285; 76/82, 82.2, 84, 88, 81.7

[56] References Cited

U.S. PATENT DOCUMENTS

| | | | |
|---|---|---|---|
| 594,723 | 11/1897 | Boettcher | 51/208 |
| 1,234,945 | 7/1917 | Sparks | 51/208 |
| 1,269,898 | 6/1918 | Ball | 76/88 |
| 1,787,478 | 1/1931 | Jackson | 76/88 |
| 2,458,856 | 1/1949 | Jacobson | 51/205 WG |
| 2,461,690 | 2/1949 | Leong | 76/84 |
| 4,719,722 | 1/1988 | Washburn | 51/205. WG X |

FOREIGN PATENT DOCUMENTS

| | | | |
|---|---|---|---|
| 46-14039 | 4/1971 | Japan | 51/208 |
| 0491447 | 9/1938 | United Kingdom | 76/84 |

*Primary Examiner*—Robert P. Olszewski

*Attorney, Agent, or Firm*—Chilton, Alix & Van Kirk

[57] ABSTRACT

A knife sharpening device employs one or more guide members which are angularly positionable in relation to a central sharpening surface so that a knife blade may be maintained at a pre-selected angle relative to the sharpening surface during the sharpening process. A pair of sharpening stones are mounted in back-to-back relationship. A guide bar is angularly positionable to define pre-established spacings with respect to opposing sharpening surfaces of the stones to thereby define fixed sharpening angles. A pin/detents locking mechanism is employed for adjustably fixing the angular position of the guide bar. In one embodiment a plurality of guide rods are fixed in eccentric angular relationship with a central columnar sharpening surface to maintain the sharpening angle of a knife blade at a pre-selected angle.

1 Claim, 6 Drawing Sheets

KNIFE SHARPENING DEVICE

BACKGROUND OF THE INVENTION

The present invention relates generally to knife sharpening devices. More particularly, the present invention relates to knife sharpening devices employing a guide member for maintaining a knife blade at a pre-selected angle in relation to a sharpening member.

Knife sharpening devices which are adapted for sharpening a knife blade by insuring that the knife blade engages the sharpening member at a pre-selected angle in relation to the sharpening member are known in the prior art. A number of such related prior art knife sharpening devices provide a feature wherein the knife blade may be inserted between the sharpening member and a guide mechanism such as a guide bar to thereby maintain a fixed angle of the knife blade during the sharpening process. The guide mechanism has a guide surface which is engaged by the back edge of the knife blade. The spacial relationship between the guide surface of the guide mechanism and the sharpening surface of the sharpening member may be calibrated to precisely define the pre-selected angle. The spacial distance between the sharpening surface and the guide surface may also be adjustable by various means to adjustably vary the pre-selected sharpening angles.

McRae U.S. Pat. No. 4,229,910, Jacobson U.S. Pat. No. 2,458,856, Brody U.S. Pat. No. 4,078,455 and Perry U.S. Pat. No. 1,181,161 all exemplify various knife sharpening devices which employ a guide rod or a guide member which cooperates with the sharpening member to provide a pre-selected sharpening angle. McRae U.S. Pat. No. 4,229,910 discloses a knife sharpening apparatus which is adjustable to maintain a knife at a pre-selected angle relative to a sharpening stone during the sharpening process. A guide bar is employed for guiding the back edge of the knife blade. The bar may be shifted to a multitude of pre-selected spacing distances between the bar and the sharpening stone so that the sharpened edge of the blade engages the stone at a desired pre-selected angle. Jacobson U.S. Pat. No. 2,458,856 discloses a kitchen knife sharpener wherein a slot is formed in a housing. A sharpening member is positioned at one edge of the slot and the other opposite edge of the slot functions as a guide member. Brody U.S. Pat. No. 4,078,455 and Perry U.S. Pat. No. 1,181,161 disclose sharpening devices which employ a pair of blade guides positioned at generally opposite sides of a sharpening stone.

SUMMARY OF THE INVENTION

The present invention is a new and improved device for sharpening a knife blade by maintaining a knife blade at a pre-selected angle during the sharpening process.

Briefly stated, the invention in a preferred form is a knife sharpening device which comprises a first sharpening element having a first sharpening surface for sharpening a knife blade. A second sharpening element having a second sharpening surface for sharpening a knife blade is disposed so that the first and the second sharpening surfaces are in an opposed spaced relationship. A guide assembly is mounted in fixed relationship to the first and the second sharpening elements. The guide assembly comprises a guide member which is pivotally positionable for selective angular positioning at a plurality of fixed positions. At at least one of the positions, the guide member is directly spaced from one of the sharpening surfaces at a pre-established distance, and at at least one other position the guide member is directly spaced from the other sharpening surface at a pre-established distance. At a given position of the guide member, a knife blade inserted between the guide member and one or other of the sharpening surfaces and engageable therewith, engages the sharpening surface at a substantially constant pre-selected sharpening angle as the blade is transversely moved against the guide member and the sharpening surface.

The first and the second sharpening elements may be sharpening stones wherein one of the stones has a coarser sharpening characteristic in comparison to the other sharpening stone. The sharpening stones may be generally rectangular shaped and mounted in back-to-back relationship. The first and the second sharpening surfaces are substantially planar and are disposed in generally parallel relationship. The guide member is pivotally mounted at opposing end portions of each of the first and the second sharpening stones. The knife sharpening device may further comprise a sharpening rod which is mounted in fixed relationship to the guide member. The sharpening rod extends generally parallel to the guide member to define a substantially constant pre-selected sharpening angle when the knife blade is inserted between the sharpening rod and the guide member.

A locking assembly for locking the guide member at each of a selected plurality of angular positions comprises a pin. Detents are formed in the end portions of the sharpening elements and the pin is angularly alignable with the detents and removably receivable therein for locking the guide member at a fixed position. The guide member may be a substantially U-shaped member. The lock assembly may comprise spring biased pins which are mounted at opposing end portions of the member.

In another embodiment of the invention, a sharpening instrument comprising a generally longitudinally extending sharpening surface extends in a generally upright orientation with respect to a support base. A plurality of generally parallel guide members extend upwardly in a generally upright orientation from the base. Each of the guide members is positioned in an eccentric angular relationship in relation to the sharpening instrument with the sharpening instrument and each of the guide members being spaced at a unique pre-established distance. A knife blade inserted between the guide member and the sharpening surface and engageable therewith engages a sharpening surface at a pre-selected substantially constant sharpening angle as the blade is moved transversely across the guide member. The guide members may be substantially identical metal rods. A platform connects the guide members. The platform is spaced from the support base with the platform at least partially retaining the sharpening instrument in a generally upright position. The platform forms an opening for receiving the sharpening instrument. The sharpening instrument is removably received by the platform and the base. In preferred form, there are four guide members.

In another embodiment of a knife sharpening device in accordance with the present invention, a base is adapted for mounting on a support surface. A rotatable generally longitudinally extending circumferential sharpening surface extends from the base at a generally oblique angle to the support surface. A motor rotates the sharpening surface. A plurality of generally parallel guide members connect the base and extend in a generally parallel relationship to the sharpening surface. Each of the guide members are spaced in a unique pre-established distance from the sharpening surface so that a knife blade inserted between a guide member and the sharpening surface and engageable therewith engages the sharpening surface at a pre-selected substantially constant sharpening angle as the sharpening surface is rotated by the motor means.

An object of the invention is to provide a new and improved knife sharpening device having efficient means for maintaining the knife blade at a pre-selected angle relative to the sharpening member.

Another object of the invention is to provide a new and improved knife sharpening device of efficient and inexpensive construction whereby the knife may be maintained at a number of pre-selected angles relative to the sharpening member.

A further object of the invention is to provide a new and improved knife sharpening device which incorporates both fine and coarse sharpening members and provides means whereby the blade of the knife may be maintained at a plurality of pre-selected angles in relation to each of the sharpening members.

Other objects and advantages of the invention will become apparent from the specification and the drawings.

DETAILED DESCRIPTION OF THE INVENTION

Figure 1:
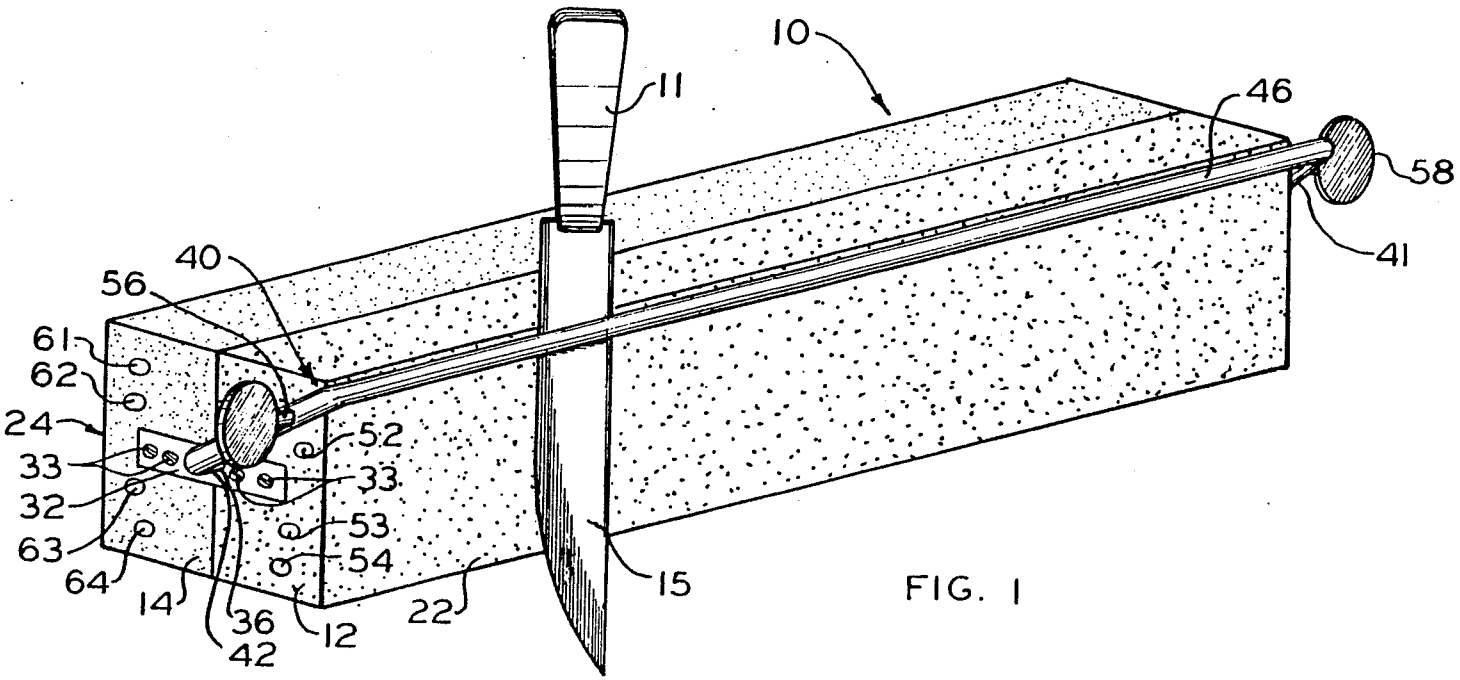
FIG. 1 is a perspective view of a knife sharpening device in accordance with the present invention and a knife for illustrating the invention.

With reference to the drawings wherein like numerals represent like parts throughout the figures, a knife sharpening device in accordance with the present invention is generally designated by the numeral 10. Knife sharpening device 10 is employed for sharpening a knife 11 by engageably guiding the back edge 13 of the knife blade for maintaining a pre-selected angular relationship between the cutting edge 15 of the knife blade and a selected one of two sharpening surfaces.

Figure 2:
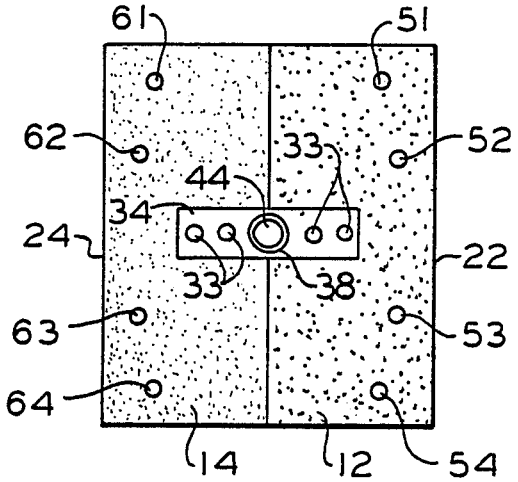
FIG. 2 is an end view of the knife sharpening device of FIG. 1 viewed from the right thereof.

With reference to FIGS. 1 and 2, a pair of substantially identical, generally rectangularly shaped sharpening stones 12 and 14 are disposed in back-to-back relationship. Sharpening stone 12 is a coarse cutting stone having a generally planar sharpening surface 22. Sharpening stone 14 is a fine sharpening stone having a generally planar sharpening surface 24 which extends in spaced generally parallel relationship with coarse sharpening surface 22.

The sharpening stones 12 and 14 may be connected by cementing the stones along their abutting surfaces and/or by connecting plates 32 and 34 which are mounted at opposing ends of the stones. The connecting plates 32 and 34 are each anchored to the adjacent coplanar ends of each of the sharpening stones by threaded fasteners 33. Each of the connector plates 32 and 34 forms a respective central boss 36 and 38. The bosses are adapted for receiving and pivotally mounting a guide bar assembly designated generally by the numeral 40.

Guide bar assembly 40 comprises a quasi-U-shaped steel bar 41. The bar 41 has a pair of axially spaced, coaxial pivot shafts 42 and 44 which are received in respective bosses 36 and 38 to provide pivotal movement therewith. The guide bar 41 comprises an angularly positionable central linear guide bar 46 which is generally parallel to surfaces 22 and 24. The guide bar 46 is pivotally positionable at a multiplicity of fixed angular positions to define a multiplicity of pre-selected spacial distances from the sharpening surfaces 22 and 24. In preferred form, the device is positioned on a table or support (not illustrated) in the upright relationship illustrated in FIG. 1, and the guide bar 46 longitudinally extends in a generally horizontal orientation.

Opposing pairs of detents 51, 52, 53 and 54 are located at pre-established locations at opposing ends of the coarse sharpening stone 12. The detents 51–54 are equidistantly spaced from the pivot axis of shafts 42 and 44. The detents function to angularly fix the guide bar 46 at selected pre-established distances or spacings from the coarse sharpening surface 22. The guide assembly 40 includes spring loaded coaxial pins 56 and 58 mounted at opposing leg portions of the guide bar 41. The pins are angularly alignable with corresponding detents 51–54 and may be manually axially retracted from the detents for changing the angular position of the guide bar 46. It will be appreciated that the detents are located at pre-established positions so that a different distance or spacing between the guide bar and the coarse sharpening surface 22 is fixed by reception of the pins 56 and 58 at each of the detent locations. In the illustrated sharpening device 10 four such spacings may be provided. Each spacing defines a unique sharpening angle.

Likewise, pairs of opposing detents 61, 62, 63 and 64 are located at opposing ends of fine sharpening stone 14 for fixing the angular position of the guide bar 46 to thereby fix the spacing of the guide bar 46 from the sharpening surface 24. Detents 61–64 are equidistantly spaced from the pivot axis of the coaxial shafts 42 and 44. The guide assembly is pivotally positionable so that the guide bar may be selectively spaced directly opposite from either the coarse sharpening surface or the fine sharpening surface as desired. Each of the detents is located to provide a different pre-selected uniform spacing between the guide bar and the fine sharpening surface 24.

It will be appreciated that the guide bar is pivotally positionable to a fixed angular position so as to be substantially equidistantly spaced along the length of the guide bar 46 from either the coarse sharpening surface 22 or the fine sharpening surface 24. The detent pairs 51-54 and 61-64 are located so as to enable the guide bar to be selectively positioned at fixed angular positions to define pre-established spacings between the guide bar and the sharpening surface. Consequently, the knife 11 to be sharpened may be inserted between either the coarse or fine sharpening surfaces and the guide bar so that the bar is engaged by the back edge 13 of the knife blade as illustrated in FIG. 1. During the sharpening process the guide bar and sharpening surfaces cooperate to thereby maintain the cutting edge 15 of the knife blade at a selected angle with respect to the sharpening surface as the knife blade is transversely moved across the sharpening surface while the cutting edge 15 engages the sharpening surface and the back edge 13 maintains sliding contact with the guide bar 46.

Each of the detent pairs essentially define a pre-established blade angle for a given knife blade when the knife blade maintains contact with both the sharpening stone and the guide bar during the described sharpening process. The sharpening process may thus be accomplished under substantially complete angular blade control. The improved blade sharpening device is easily adjustable to provide a desired sharpening angle in accordance with the width and dimensions of the knife blade and the desired application for both a coarse and a fine sharpening surface as the blade is forcefully displaced along the axis of the guide bar. In the illustrated embodiment, the guide bar 46 and the sharpening surfaces are generally parallel. Consequently, each pivotal position of the guide bar defines a sharpening angle which is constant throughout the longitudinal extent of the guide bar. In an alternative embodiment (not illustrated), the guide bar and sharpening surfaces are not parallel and a different sharpening angle could be provided at different longitudinal positions along the guide bar.

Figure 6:
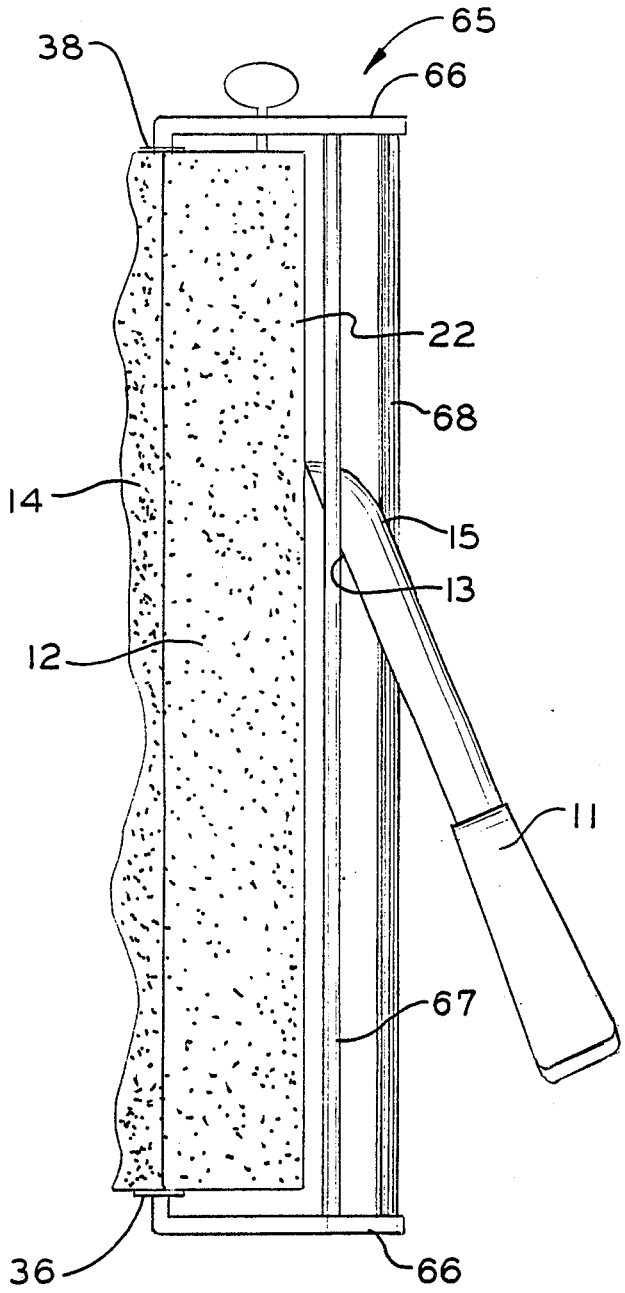
FIG. 6 is a fragmentary top plan view of a modified embodiment of the knife sharpening device of FIG. 1 together with a knife for illustrating the invention.

With reference to FIG. 6, an alternate embodiment of a guide bar assembly for knife sharpening device 10 is generally designated by the numeral 65. Guide bar assembly 65 includes a pair of generally L-shaped members 66 which are pivotally mounted to bosses 36 and 38. A guide bar 67 extends between members 66 and functions as a guide member in the manner previously described for guide bar 46. A sharpening rod 68 is mounted in fixed relationship to members 66 and extends therebetween in generally parallel relationship to guide bar 67. Sharpening rod 68 may be composed of butcher steel or other material which is suitable for sharpening the surface of a blade. It will be appreciated that sharpening rod 68 and guide member 67 pivot in tandem with respect to the sharpening surfaces 22 and 24 of the knife sharpening device. The sharpening rod 68 is spaced from the guide member 67 so that the knife 11 may be inserted between the guide bar 67 and the sharpening rod 68 with the back edge 13 of the knife engaging the guide bar 67 and the cutting edge 15 of the knife blade engaging the sharpening rod 68 to define a constant pre-established finishing sharpening angle for the knife blade. The latter described guide bar assembly 65 provides the feature wherein after the knife is initially sharpened at the selected sharpening angle relative to the cutting stone, the knife may be inserted between the guide bar 67 and the sharpening rod 68 to finish the sharpening process at a constant pre-selected sharpening angle.

Figure 3:
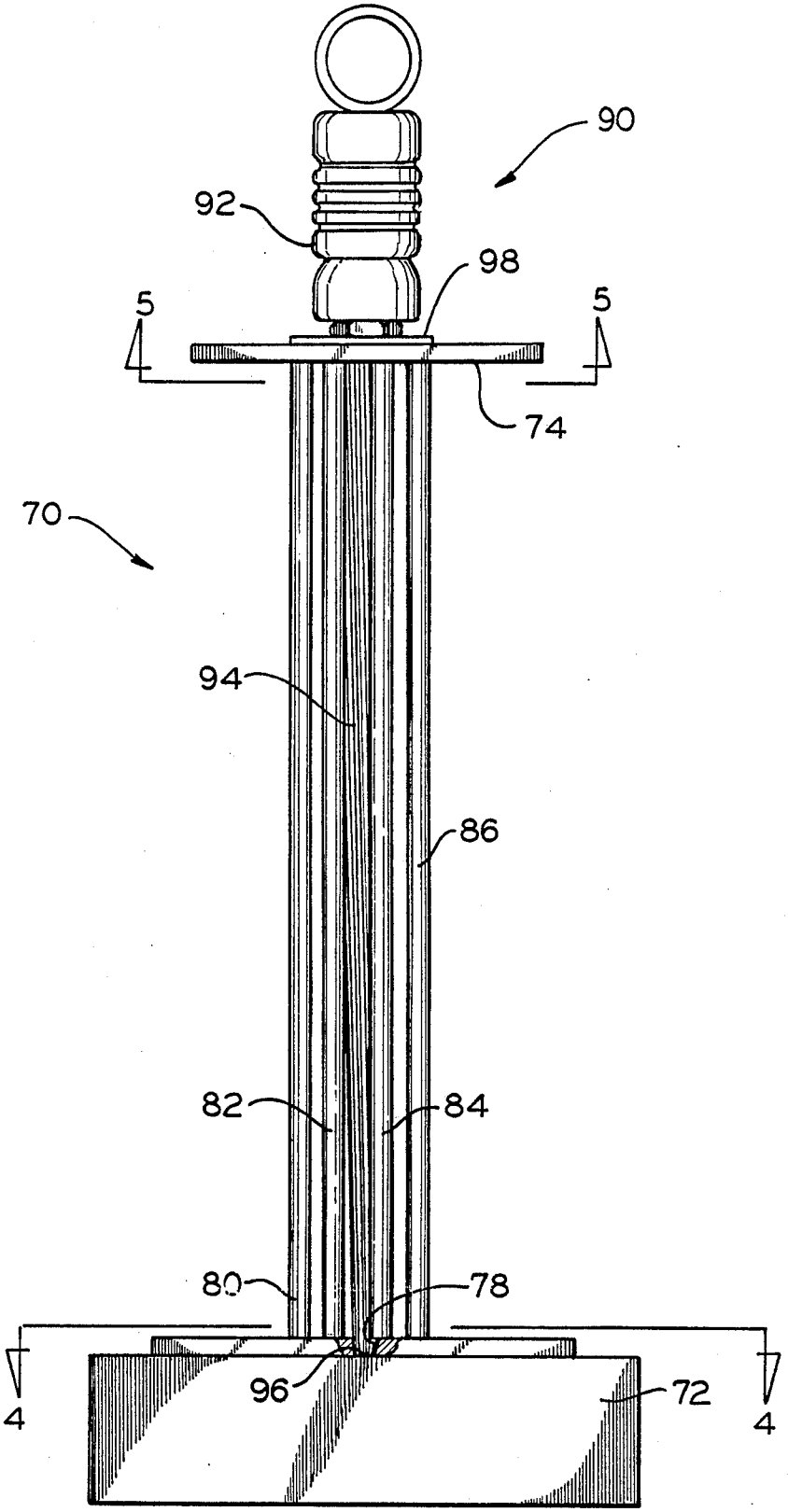
FIG. 3 is a perspective view, partly broken away, of a second embodiment of a knife sharpening device in accordance with the present invention.
Figure 4:
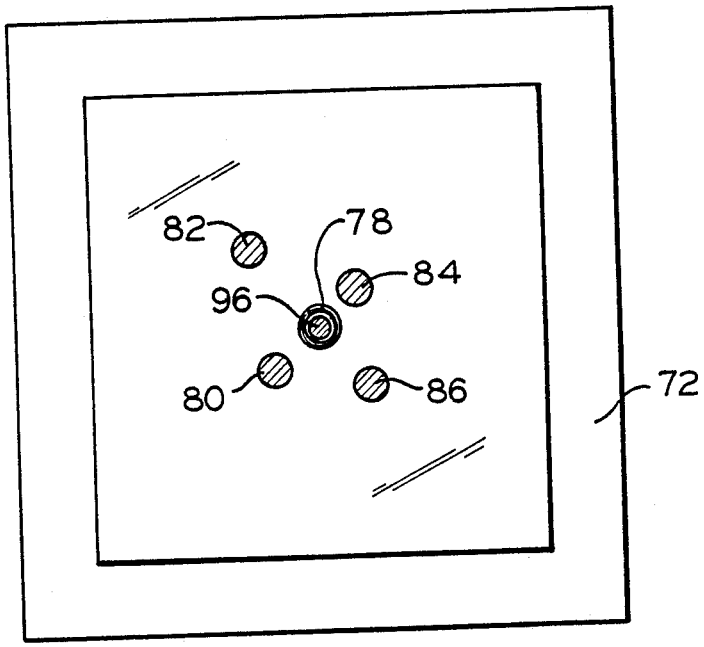
FIG. 4 is a sectional view of the second knife sharpening device embodiment taken along the line 4—4 of FIG. 3.

With reference to FIGS. 3 and 4, a second embodiment of a knife sharpening device in accordance with the present invention is generally designated by the numeral 70. Sharpening device 70 is generally adapted for positioning in the upright orientation illustrated in FIG. 3 for sharpening a knife blade at a pre-selected angle with respect to a centrally disposed sharpening column. The knife blade is inserted generally horizontally between the sharpening member and a selected guide rod and moved generally transversely against the central sharpening column as will be detailed below.

Knife sharpening device 70 comprises a bi-level base 72 and an upper connecting platform 74 which is vertically spaced from the base and generally parallel thereto. Four substantially identical guide rods 80, 82, 84 and 86 are threaded at opposite ends into the base and the support platform. The guide rods extend in generally parallel fixed relationship and have substantially equal lengths. The connecting platform 74 is a plate-like member which threadably receives the upper ends of the rods. The platform forms a central opening 76. The base 72 forms a central tapered recess 78 which generally aligns with opening 76.

A sharpening instrument 90 which may be of conventional columnar form is slidably received in opening 76 from an upper position. The sharpening instrument 90 comprises a handle 92 and a slightly tapered columnar sharpening surface 94 having a tapered tip 96. The sharpening surface 94 is formed from butcher steel or other suitable material. The received sharpening instrument extends so that the tip 96 of the instrument is received in recess 78 to thereby retainably support the sharpening instrument in a generally vertical upright disposition as illustrated. The handle 92 has a flange 98 which is closely adjacent the upper surface of platform 74.

Figure 5:
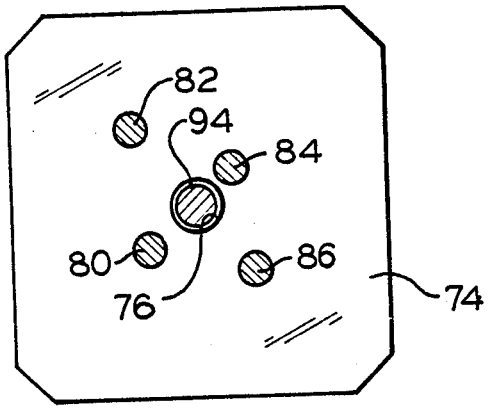
FIG. 5 is a sectional view of the second knife sharpening device embodiment taken along the line 5—5 of FIG. 3.

The central axis of the columnar sharpening surface 94 of the sharpening tool 90 is generally parallel to each of the guide rods 80, 82, 84 and 86. The guide rods 80, 82, 84 and 86 are spaced from the sharpening instrument in a generally eccentric relationship as best illustrated in FIGS. 4 and 5. The guide rods are each spaced at different distances from the closest portions of adjacent sharpening surface 94 of the sharpening tool. The distance between each of the guide rods and the sharpening distance is selected to provide a different pre-established angle at a given vertical height between a knife blade to be sharpened and the sharpening surface 94 of the sharpening instrument. If the guide rods and the sharpening surface are cylindrical and parallel, a constant sharpening angle for a given knife blade will be defined between a given guide rod and the sharpening surface regardless of the vertical position of the inserted knife blade. If the sharpening surface and/or the guide rods are tapered, the sharpening angle defined between the sharpening surface and a given guide rod may vary in accordance with the vertical height of the knife blade.

It will be appreciated that knife sharpening device 70 functions to sharpen the knife blade so that the cutting edge of the blade engages the sharpening surface 94 at a desired pre-selected angle. The desired angle is defined by transversely inserting the knife blade between the selected guide rod and the sharpening tool so that the back edge of the blade engages the guide rod and the cutting edge of the blade engages the sharpening surface. The knife blade is transversely moved across the sharpening surface of the sharpening tool by sliding the rear edge of the blade transversely across the selected guide rod (in a generally horizontal direction). While it is believed that four guide rods and hence four pre-established angles (or continuum of angles) are the optimum number, it should be appreciated that a knife sharpening device in accordance with the present invention may incorporate any number of guide rods. The sharpening surface 94 need not be a portion of a removeable sharpening tool as illustrated, but may take the form of a sharpening surface which is mounted in fixed position (not illustrated).

Figure 7:
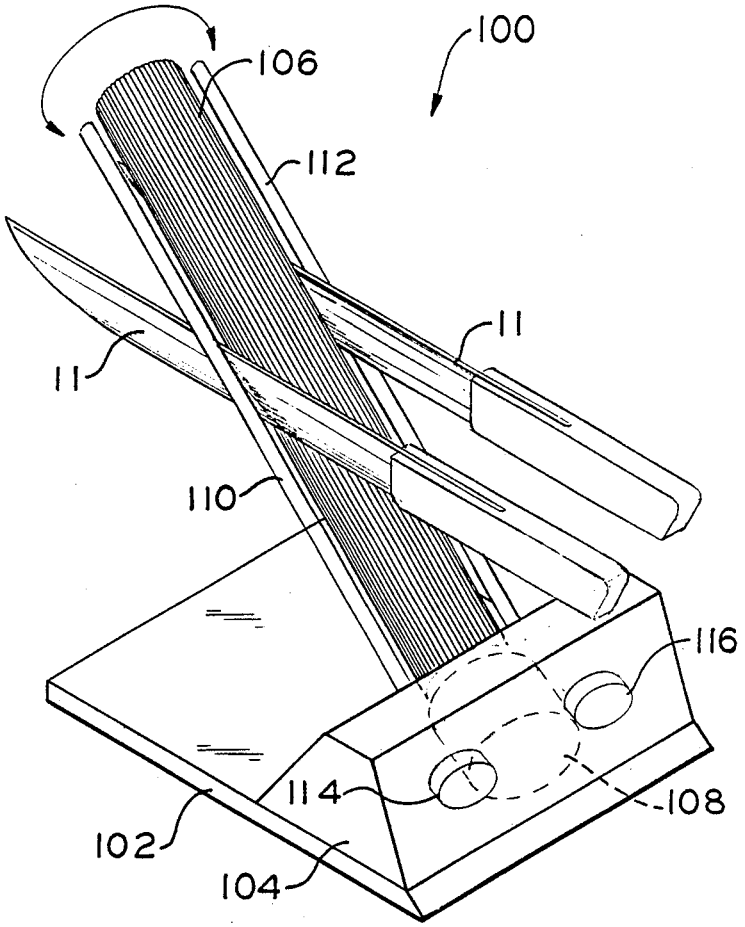
FIG. 7 is a perspective view of a third embodiment of a knife sharpening device in accordance with the present invention together with a pair of knives for illustrating the invention.

With reference to FIG. 7, another embodiment of a knife sharpening device in accordance with the present invention is generally designated by the numeral 100. Knife sharpening device 100 comprises a generally planar platform 102 which mounts a base 104. A rotatable, generally cylindrical sharpening column 106 is rotatably mounted to the base 104, extends from the base 104 at an oblique angle to the platform. The base 104 has a trapezoidal prism-like shape and houses an electric motor 108 (schematically illustrated). The motor 108 may be employed to rotate the sharpening column 106 in either a clockwise or counterwise direction.

A pair of guide bars 110 and 112 extend from the base 104 in generally parallel relationship with the sharpening column. Guide bars 110 and 112 are spaced at different distances from the sharpening surface. The quide bars 110 and 112 define a unique pre-selected sharpening angle when a knife is inserted so as to engage a guide bar and the sharpening surface of column 106 as illustrated in FIG. 7. It will be appreciated that the knife is preferably inserted at a generally horizontal orientation with respect to the platform and consequently an oblique orientation with respect to the sharpening surface so as to prevent the formation of hollow portions in the blade cutting surface during the sharpening process.

In operation the motor drivably rotates the sharpening column 106. The knife 11 is inserted so that the back edge 13 engages a selected guide member 110 or 112 and the cutting edge 15 of the blade engages the sharpening column 106. As the sharpening column rotates and the back edge of the blade is maintained against the guide bar 110 or 112, the rotating sharpening column continuously rotatably engages the cutting edge of the blade to thereby sharpen the blade. The motor is preferably bidirectional so that both guide bars may be separately efficiently employed to define unique preselected sharpening angles for the knife blade. A manually actuable on-off switch 114 and a manually actuable directional switch 116 are located at a front panel fo the base for operating the knife sharpening device.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A knife sharpening device comprising:

base means for forming a base supportable on a support surface;

sharpening means comprising a rotatable, generally longitudinally extending cylindrical sharpening surface having a central rotational axis extending from said base means at a generally oblique angle on the order of approximately 45 degrees relative to said support surface;

means for rotating said sharpening surface; and two generally parallel guide members connected to said base means in fixed relationship therewith and extending in generally parallel relationship to said rotational axis and lying on opposite sides of said sharpening surface in a common plane extending at said generally oblique angle to said support surface, each said guide member comprising a metal rod equidistantly spaced at a unique pre-established distance from said sharpening surface so that a knife blade inserted between a said guide member and the sharpening surface and engageable therewith engages the sharpening surface at an oblique angle relative to said axis to sharpen the blade at a pre-selected substantially constant sharpening angle as said sharpening surface is rotated and said blade is moved generally transversely across the sharpening surface and the said guide member in a direction generally parallel to said support surface.

* * * * *